US007150169B2

(12) United States Patent
Kim et al.

(10) Patent No.: US 7,150,169 B2
(45) Date of Patent: Dec. 19, 2006

(54) LUBRICANT-SUPPLYING APPARATUS FOR DRY-LUBRICATED ALUMINUM-CLAD WIRE DRAWING, AND METHOD OF SUPPLYING LUBRICANTS

(75) Inventors: Seon-tae Kim, Seoul (KR); Jeong-ho Kim, Yongin-si (KR); Jong-hae Kim, Yongdeungpo-gu (KR)

(73) Assignee: LG Cable Ltd., Seoul (KR)

( * ) Notice: Subject to any disclaimer, the term of this patent is extended or adjusted under 35 U.S.C. 154(b) by 84 days.

(21) Appl. No.: 10/984,825

(22) Filed: Nov. 9, 2004

(65) Prior Publication Data

US 2005/0103074 A1 May 19, 2005

(30) Foreign Application Priority Data

Nov. 13, 2003 (KR) ..... 10-2003-0080279

(51) Int. Cl.
*B21C 9/00* (2006.01)

(52) U.S. Cl. ..... 72/43; 72/287

(58) Field of Classification Search ..... 72/43–45, 72/278, 282, 286, 287
See application file for complete search history.

(56) References Cited

U.S. PATENT DOCUMENTS 2,199,495 A * 5/1940 Johnson ..... 72/44
2,199,496 A * 5/1940 Johnson ..... 72/43
3,935,723 A * 2/1976 Fieldsend et al. ..... 72/275
4,329,861 A * 5/1982 Griffiths ..... 72/19.4
4,445,351 A * 5/1984 Thompson et al. ..... 72/43
4,790,489 A * 12/1988 Paul ..... 241/186.4
5,671,627 A * 9/1997 Lisciani ..... 72/43
5,801,129 A * 9/1998 Damm ..... 508/175

FOREIGN PATENT DOCUMENTS

JP 8015531 1/1996
JP 8215738 8/1996

* cited by examiner

*Primary Examiner*—Daniel C. Crane
(74) *Attorney, Agent, or Firm*—John P. White; Cooper & Dunham LLP

(57) ABSTRACT

The present invention is to provide a lubricant-supplying apparatus for dry-wire drawing, and a method of supplying the same, which effectively prevents a lubricant tunnel phenomenon, thus allowing an easy supply of the lubricants during high-speed dry-wire drawing, and which enables deteriorated lubricants or a lump of lubricants to be pulverized and reused.

7 Claims, 2 Drawing Sheets

LUBRICANT-SUPPLYING APPARATUS FOR DRY-LUBRICATED ALUMINUM-CLAD WIRE DRAWING, AND METHOD OF SUPPLYING LUBRICANTS

BACKGROUND OF THE INVENTION

1. Field of the Invention

The present invention relates to a lubricant-supplying apparatus for dry-wire drawing, and a method of supplying the lubricants that allows an easy supply of wire drawing lubricants during a process of dry-wire drawing for an aluminum-clad wire, so that the lubricants can be easily applied to the surface of a wire rod and the wire drawing can be easily performed.

2. Description of the Related Art

Generally, an aluminum-clad steel wire (AW) for power lines is provided in such a form that a steel wire has an aluminum cladding on its surface, whereby the steel wire inside of the aluminum-clad steel wire acts to increase the tensile strength of a wire rod and the aluminum cladding on the surface of the wire rod acts mainly as an electric conductor.

Several aluminum-clad steel wires are stranded, and then used for aerial cables, which are power lines for high voltage transmission.

Generally, according to a conventional method of producing AW, AW is produced through several stages of a wire-drawing process for obtaining a wire rod 5 having a desired diameter after applying aluminum cladding to the surface of a steel wire.

Among the wire drawings, dry-wire drawing, used for producing AW, is a method that uses powders comprising soap components not in a liquid state but in a solid state, and has been widely used for high-speed wire drawing.

Referring to FIG. 1, a conventional lubricant-agitating apparatus used for the dry-wire drawing comprises a lubricant container 10 for containing the lubricants and a conveying means 20, consisting of a pair of upper and lower rollers provided in the lubricant container 10, in which each of the rollers is formed on its outer surface with grooves to guide the wire rod 5.

Further, as an invention provided for enhancing the conventional lubricant-agitating apparatus, a roller-agitating apparatus, disclosed in Japanese Patent Laid-open Publication No. (Hei) 08-215738, has rollers made of a magnetic material, each of which is formed on the outer surface thereof with a wire-rod guide-groove and a protrusion.

However, as shown in FIG. 2, the conventional lubricant-agitating apparatus has a problem in that when the wire rod 5 is drawn by a pressure die 30, deteriorated lubricants are unnecessarily accumulated around an inlet of a penetration hole 31*a* of the pressure die 30 through which the wire rod 4 is advanced, thereby wasting lubricants.

Furthermore, the deteriorated lubricants often flow backwards into the lubricant container 10, and the deteriorated lubricants having flowed backward are cooled into a lump-shaped solid 1 or cause a lubricant tunnel phenomenon by which the solidified lubricants form a lubricant tunnel 2, thereby preventing a smooth supply of the lubricants around an outer periphery of the wire rod 5.

Thus, in order to solve these problems, there has been used a lubricant-agitating apparatus formed with an opening for exhausting the deteriorated lubricants as disclosed in Japanese Utility Model Laid-open Publication No. (Hei) 2-59809 and Japanese Patent Laid-open Publication No. (Hei) 8-155531, a method disclosed in. Japanese Patent Laid-open Publication No. (Hei) 10-296322, or a lubricant-agitating apparatus provided with a power transmission apparatus as disclosed in Korean Patent Laid-open Publication No. 1995-0010988.

However, since the above lubricant agitating apparatuses have many components, many manufacturing processes are required, the lubricant agitating apparatus becomes complicated, and thus costs for the components are raised.

SUMMARY OF THE INVENTION

The present invention has been made to solve the above problems, and it is an object of the present invention to provide a lubricant-supplying apparatus for dry-wire drawing, and a method of supplying the same, which effectively prevents a lubricant tunnel phenomenon, thus allowing an easy supply of the lubricants during high-speed dry-wire drawing, and which enables deteriorated lubricants or a lump of lubricants to be pulverized and reused.

In accordance with one aspect of the present invention, the above and other objects can be accomplished by the provision of a lubricant-supplying apparatus for dry-lubricated aluminum-clad wire drawing, including: a lubricant container filled with lubricants, the container being formed at one side thereof with an inlet, such that a wire rod to be processed is introduced into the lubricant container, and provided at the other side thereof with a die having a penetration hole formed at the center of the die, such that the wire rod passes through the penetration hole; and a conveying means for conveying the wire rod from the inlet of the lubricant container to pass through the penetration hole of the die, wherein the lubricant container comprises a support frame to support the lubricant container such that the lubricant container can rotate in a circumferential direction, and a driving means connected to the lubricant container to rotate the lubricant container, the lubricants being smoothly supplied around a periphery of the wire rod while the lubricant container is rotated.

In accordance with another aspect of the present invention, there is provided a method of supplying lubricants around a periphery of a wire rod in a lubricant-supplying apparatus for dry-lubricated aluminum-clad wire drawing, the lubricant-supplying apparatus including: a lubricant container filled with lubricants, the container being formed at one side thereof with an inlet such that the wire rod to be processed is introduced into the lubricant container, and provided at the other side thereof with a die having a penetration hole formed at the center of the die such that the wire rod passes through the penetration hole; and a conveying means for conveying the wire rod, the method comprising the steps of: a wire-rod-supplying step for supplying the wire rod from the inlet of the lubricant container to the penetration hole of the die using the conveying means; and a lubricant-supplying step for supplying the lubricants to the periphery of the wire rod by rotating the lubricant container using a driving means for rotating the lubricant container.

BRIEF DESCRIPTION OF THE DRAWINGS

The foregoing and other objects and features of the present invention will be more clearly understood from the following detailed description taken in conjunction with the accompanying drawings, in which.

DESCRIPTION OF THE PREFERRED EMBODIMENTS

Figure 1:
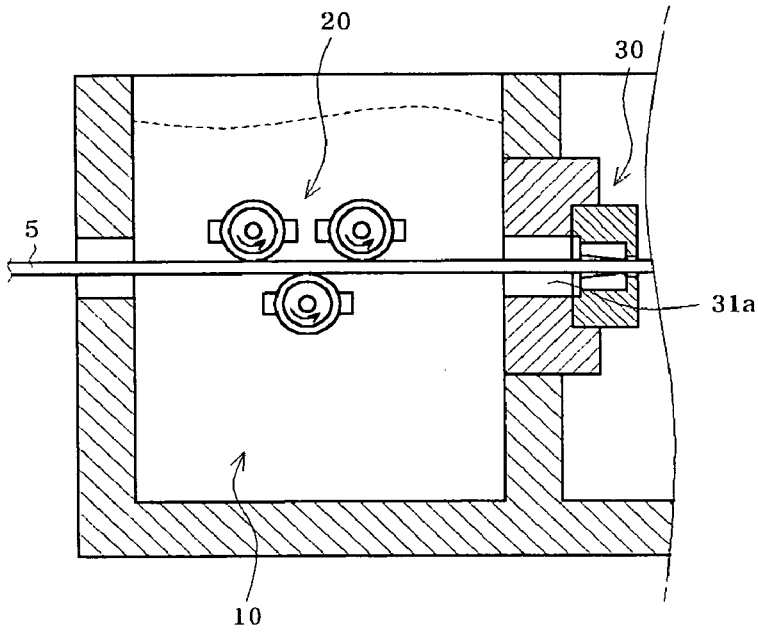
Fig. 1 (PRIOR ART)
FIG. 1 is a cross-sectional view illustrating the structure of a conventional lubricant-supplying apparatus for dry-wire drawing.
Figure 2:
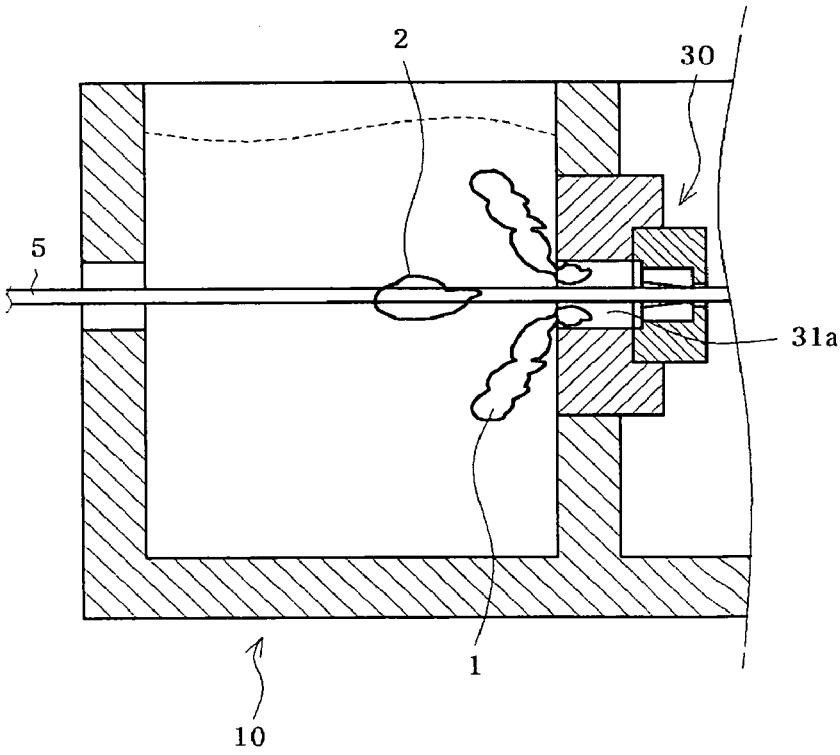
Fig. 2 (PRIOR ART)
FIG. 2 is a view illustrating the conventional lubricant-supplying apparatus in which a lubricant tunnel phenomenon and accumulation of the lubricants are generated around rollers, not shown.

Preferred embodiments of the present invention will now be described in detail with reference to the accompanying drawings in which the same components as that of the conventional apparatus are denoted by the same reference numeral. It should be noted that the embodiment of the present invention does not limit the present invention, and is presented only as an example.

Figure 3:
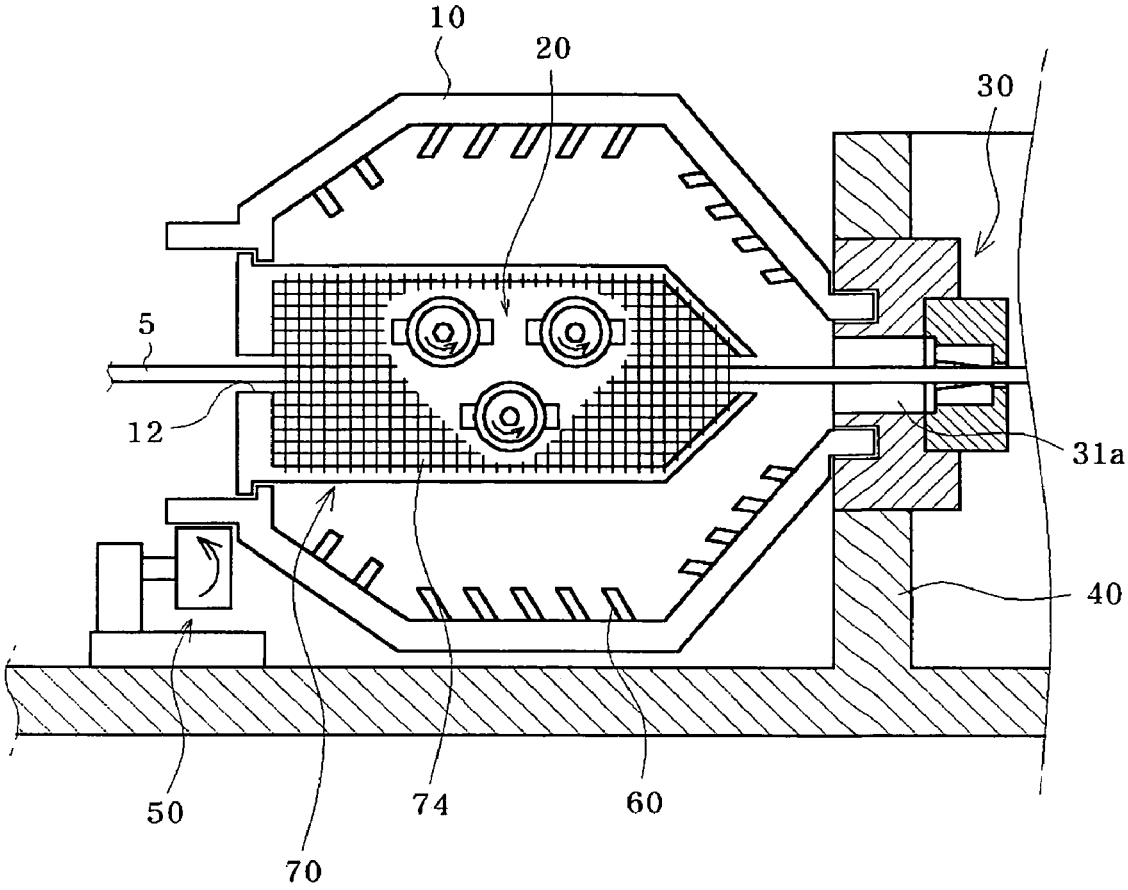
FIG. 3 is a cross-sectional view illustrating the structure of an apparatus for supplying dry-wire drawing lubricants according to the present invention.

FIG. 3 is a cross-sectional view illustrating the structure of an apparatus for supplying dry-wire drawing lubricants according to the present invention.

Referring to FIG. 3, like the conventional apparatus for supplying dry-wire drawing lubricants, a lubricant-supplying apparatus for dry-wire drawing of the present invention also comprises a lubricant container 10 through which a wire rod 5 passes, and a conveying means 20 for conveying the wire rod 5.

Here, the lubricant container 10 is rotatably installed to a supporting frame 40 in a horizontal direction, and is connected to a driving means 50 to rotate the lubricant container 10.

A pressure die 30 of the lubricant container 10 is connected to the rear end of the supporting frame 40, and an outlet for the wire rod 5 provided at the rear end of the lubricant container 10 is slidably connected to the center of the pressure die 30.

The lubricant container 10 is connected via a belt or a gear to the driving means 50 consisting of a driving motor, and is thus rotated by driving the driving motor 40.

The lubricant container 10 is rotated at a speed roughly between 5 and 120 rpm, and effectively performs agitation of dry lubricants, thereby preventing a lubricant tunnel phenomenon in the lubricant container 10.

Furthermore, as the lubricant container 10 is rotated by the driving means, the lubricants are prevented from flowing backward into the lubricant container 10, and from being solidified at an inlet of a penetration hole 31*a* of the pressure die 30, so that the lubricants can be smoothly supplied to the periphery of the wire rod 5 to be processed.

At this time, it is desirable that the outlet for the wire rod 5, provided at the rear end of the lubricant container 10, that is, the lubricant container around a block-shaped connection portion of the die 30, ia formed in a conical shape, in order that a lump of lubricants having flowed backward to the lubricant container 10 from the inlet of the penetration hole 31*a* of the pressure die 30 can easily move to the rear of the lubricant container 10.

Meanwhile, the lubricant container 10 has a plurality of protrusions 60 formed on an inner wall of the lubricant container 10, so that when deteriorated lubricants or the lump of lubricants having flowed backward to the lubricant container 10 from the inlet of the pressure die 30 is moved backward to the lubricant container 10 by the rotation of the lubricant container 10, the deteriorated lubricants or the lump of lubricants are pulverized by the protrusions 60 on the inner wall of the lubricant container 10.

Furthermore, the lubricant container 10 is installed with a porous sieve 70 adapted to rotate in the circumferential direction around the rotational center of the lubricant container 10.

The porous sieve 70 is a cylindrical meshed net formed, around the meshed net, with lubricant passage apertures 74 through which the lubricants pass.

In order to rotate the porous sieve 70, the porous sieve 70 may be connected to the driving means 50 for rotating the lubricant container 10, or to an additional driving motor.

Accordingly, powders of the lubricants, finely pulverized by the protrusions 60 formed on the inner wall of the lubricant container 10, pass through the meshed net-shaped porous sieve 70, and are then moved around the wire rod 5 as the object to be processed. Then, as the wire rod 5 moves, the powders of the lubricants are supplied to the die 30 while moving in the direction of the die 30.

Here, since there is a danger that the powders of the lubricants, finely pulverized by the protrusions 60 on the inner wall of the lubricant container 10, may accumulate around the lubricant passage apertures 74 of the porous sieve 70 in the lubricant container 10, it is desirable that the porous sieve 70 be rotated in the opposite direction of the rotational direction of the lubricant container 10.

Preferably, the porous sieve 70 is formed with sharpened edges or protrusions 60 to pulverize lumps of lubricants. Furthermore, it is possible to sequentially pulverize lumps of lubricants into a fine powder using a plurality of layers of the porous sieve 70.

It is desirable that the rear end of the porous sieve 70 facing the die 30 has a diameter such that it closely surrounds the outer periphery of the wire rod 5 to be processed, so that the solidified lubricants, having flowed backward to the lubricant container 10 from the die 30, are prevented from directly flowing in the porous sieve 70 through the rear end of the porous sieve 70.

Accordingly, the lubricant-supplying apparatus for the dry-lubricated AW drawing does not unnecessarily generate the deteriorated lubricants at the inlet of the penetration hole 31*a* of the die 30, where the wire rod 5 to be processed is drawn, and the deteriorated lubricants do not flow backward into the lubricant container 10, thereby enhancing the quality of the wire rod 5.

Furthermore, even though the deteriorated lubricants having flowed backward are cooled into a lump-shaped solid, the deteriorated lubricants can be finely pulverized by the plurality of protrusions 70 formed on the inner wall of the lubricant container 10 and by the meshed sieve-shaped porous sieve 70 rotatably installed in the lubricant container 10, so that the lubricants can be smoothly supplied to the periphery of the wire rod 5.

Furthermore, since the lubricant-supplying apparatus for the dry-wire drawing has a simple structure and does not require many components, the apparatus can be easily manufactured, and manufacturing costs thereof can be reduced.

A method of supplying lubricants according to the configuration described above will be described as follows.

First, as a wire-rod-supplying step, a wire rod 4 is supplied from the inlet of the lubricant container 10 to the perforation hole 31*a* of the pressure die 30 by the conveying means 20, and then, as a lubricant-supplying step, lubricants are supplied to the periphery of the wire rod 5 by rotating the lubricant container 10, using the driving means 50 for rotating the lubricant container 10.

Here, it is desirable that the method of supplying the lubricants further comprises a lubricant-pulverizing step for pulverizing the lubricants with the plurality of protrusions formed on an inner wall of the lubricant container during the lubricant-supplying step.

Furthermore, it is desirable that the method of supplying the lubricants further comprises a lubricant passage-pulverizing step for pulverizing the lubricants while the lubricants pass through the lubricant passage apertures 74 of the porous sieve 70 provided around the wire rod 5 and rotating in a direction opposite the rotational direction of the lubricant container 10 during the lubricant-supplying step.

As is apparent from the description, the lubricant-supplying apparatus for dry-lubricated aluminum wire drawing according to the present invention allows the lubricant container with the protrusions formed on the inner wall of the container to be rotated, effectively restricting the tunnel phenomenon of the dry lubricants, and is installed with the meshed sieve-shaped means in the container to pulverize the deteriorated lubricants or the lump of lubricants, so that reproduced and enhanced lubricants having a predetermined size or less are supplied, thereby preventing the lubricants from being blocked due to the lumping of the lubricants. Accordingly, the lubricant-supplying apparatus of the invention allows smooth wire-drawing, thereby reducing wire breakage, enhancing the quality of the wire rod, and reducing waste of the lubricants, leading to a reduction in costs, and allowing an effective application to high-speed wire drawing.

It should be understood that the embodiments and the accompanying drawings as described above have been described for illustrative purposes and the present invention is limited only by the following claims. Further, those skilled in the art will appreciate that various modifications, additions and substitutions are allowed without departing from the scope and spirit of the invention as set forth in the accompanying claims.

What is claimed is:

1. A lubricant-supplying apparatus for dry-lubricated aluminum-clad wire drawing, including:

a lubricant container filled with lubricants, the container being formed at one side thereof with an inlet, such that a wire rod to be processed is introduced into the lubricant container, and provided at the other side thereof with a die having a penetration hole formed at the center of the die, such that the wire rod passes through the penetration hole; and a conveying means for conveying the wire rod from the inlet of the lubricant container to pass through the penetration hole of the die, wherein the lubricant container includes a support frame to support the lubricant container, such that the lubricant container can rotate in a circumferential direction, and a driving means connected to the lubricant container to rotate the lubricant container, the lubricants being smoothly supplied around a periphery of the wire rod while the lubricant container is rotated, and wherein the lubricant container is installed with a cylindrical porous sieve such that the cylindrical porous sieve surrounds the periphery of the wire rod, the porous sieve having a plurality of lubricant passage apertures formed around the porous sieve.

2. The apparatus as set forth in claim 1, wherein the lubricant container has a plurality of protrusions formed on an inner wall of the lubricant container.

3. The apparatus as set forth in claim 1, wherein the lubricant container has a conical shape at a rear end facing the die, so that the rear end of the lubricant container has a diameter gradually decreasing in the direction of the die.

4. The apparatus as set forth in claim 1, wherein the porous sieve is rotatably installed in the lubricant container such that the porous sieve can be rotated in a direction opposite the rotational direction of the lubricant container.

5. The apparatus as set forth in claim 1, wherein the rear end of the porous sieve faces the die and has a diameter closely surrounding the periphery of the wire rod, so that the lubricants solidified after flowing backward to the lubricant container from the die are prevented from directly flowing in the porous sieve through the rear end of the porous sieve.

6. A method of supplying lubricants around a periphery of a wire rod in a lubricant-supplying apparatus for dry-lubricated aluminum-clad wire drawing, the lubricant-supplying apparatus including: a lubricant container filled with lubricants, the container being formed at one side thereof with an inlet, such that the wire rod to be processed is introduced into the lubricant container, and provided at the other side thereof with a die having a penetration hole formed at the center of the die, such that the wire rod passes through the penetration hole; and a conveying means for conveying the wire rod, the method comprising the steps of:

a wire-rod-supplying step for supplying the wire rod from the inlet of the lubricant container to the penetration hole of the die using the conveying means;

a lubricant-supplying step for supplying the lubricants to the periphery of the wire rod by rotating the lubricant container, using a driving means for rotating the lubricant container; and a lubricant pulverizing step for pulverizing the lubricants with a plurality of protrusions formed on an inner wall of the lubricant container during the lubricant-supplying step; and a lubricant passage-pulverizing step for pulverizing the lubricants while the lubricants pass through lubricant passage apertures of a porous sieve provided around the wire rod and rotated in a direction opposite the rotational direction of the lubricant container during the lubricant-supplying step.

7. A method of supplying lubricants around a periphery of a wire rod in a lubricant-supplying apparatus for dry-lubricated aluminum-clad wire drawing, the lubricant-supplying apparatus including: a lubricant container filled with lubricants, the container being formed at one side thereof with an inlet, such that the wire rod to be processed is introduced into the lubricant container, and provided at the other side thereof with a die having a penetration hole formed at the center of the die, such that the wire rod passes through the penetration hole; and a conveying means for conveying the wire rod, the method comprising the steps of:

a wire-rod-supplying step for supplying the wire rod from the inlet of the lubricant container to the penetration hole of the die using the conveying means;

a lubricant-supplying step for supplying the lubricants to the periphery of the wire rod by rotating the lubricant container, using a driving means for rotating the lubricant container; and a lubricant passage-pulverizing step for pulverizing the lubricants while the lubricants pass through lubricant passage apertures of a porous sieve provided around the wire rod and rotated in a direction opposite the rotational direction of the lubricant container during the lubricant-supplying step.

* * * * *